US009438973B2

(12) United States Patent
Lin et al.

(10) Patent No.: US 9,438,973 B2
(45) Date of Patent: Sep. 6, 2016

(54) SPEAKER

(71) Applicant: HON HAI PRECISION INDUSTRY CO., LTD., New Taipei (TW)

(72) Inventors: Yi-Cheng Lin, New Taipei (TW); Chang-Da Ho, New Taipei (TW); Ting-Yi Liao, New Taipei (TW); Shih-Pin Lin, New Taipei (TW); Sei-Ping Louh, New Taipei (TW); Jen-Tsorng Chang, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 14/579,596

(22) Filed: Dec. 22, 2014

(65) Prior Publication Data

US 2016/0127814 A1 May 5, 2016

(30) Foreign Application Priority Data

Nov. 5, 2014 (TW) ..... 103138439 A

(51) Int. Cl.
*H04R 1/02* (2006.01)
*H04R 19/02* (2006.01)

(52) U.S. Cl.
CPC ..... *H04R 1/02* (2013.01); *H04R 19/02* (2013.01); *H04R 2400/03* (2013.01); *H04R 2499/11* (2013.01)

(58) Field of Classification Search
CPC ..... H04R 2440/00–2440/07; H04R 1/02; H04R 9/06; H04R 1/025; H04R 1/026; H04R 7/04
USPC ..... 381/152, 333, 388–389, 431
See application file for complete search history.

(56) References Cited

U.S. PATENT DOCUMENTS

| | | | | |
|---|---|---|---|---|
| 5,115,472 | A * | 5/1992 | Park | H04R 1/028 381/152 |
| 6,215,882 | B1 * | 4/2001 | Heron | H04R 1/025 381/152 |
| 7,103,190 | B2 * | 9/2006 | Johnson | H04R 7/04 381/152 |
| 8,073,162 | B2 * | 12/2011 | Ando | H04R 1/403 381/152 |
| 2004/0240687 | A1 * | 12/2004 | Graetz | H04R 7/045 381/152 |
| 2007/0165887 | A1 * | 7/2007 | Shin | H04R 9/045 381/152 |

* cited by examiner

*Primary Examiner* — Suhan Ni
(74) *Attorney, Agent, or Firm* — Zhigang Ma

(57) ABSTRACT

A speaker includes a hollow casing, a vibration plate, a vibrator, a wireless communication unit, and a processor. The casing defines a receiving space. The vibration plate is secured to the casing, and includes a first portion received in the receiving space and a second portion protruding out of the casing. The vibrator is received in the receiving space and attached to the first portion. The processor is configured to control the vibrator to vibrate when the speaker receives a wireless signal via the wireless communication unit, thereby allowing the vibration plate to vibrate and output sound.

19 Claims, 5 Drawing Sheets

SPEAKER

FIELD

The subject matter herein generally relates to a speaker.

BACKGROUND

A speaker is an energy transducer that transforms an electrical signal to mechanical vibration. Then, the ambient air around the speaker is pushed to generate sound.

BRIEF DESCRIPTION OF THE DRAWINGS

Implementations of the present technology will now be described, by way of example only, with reference to the attached figures.

DETAILED DESCRIPTION

Figure 1:
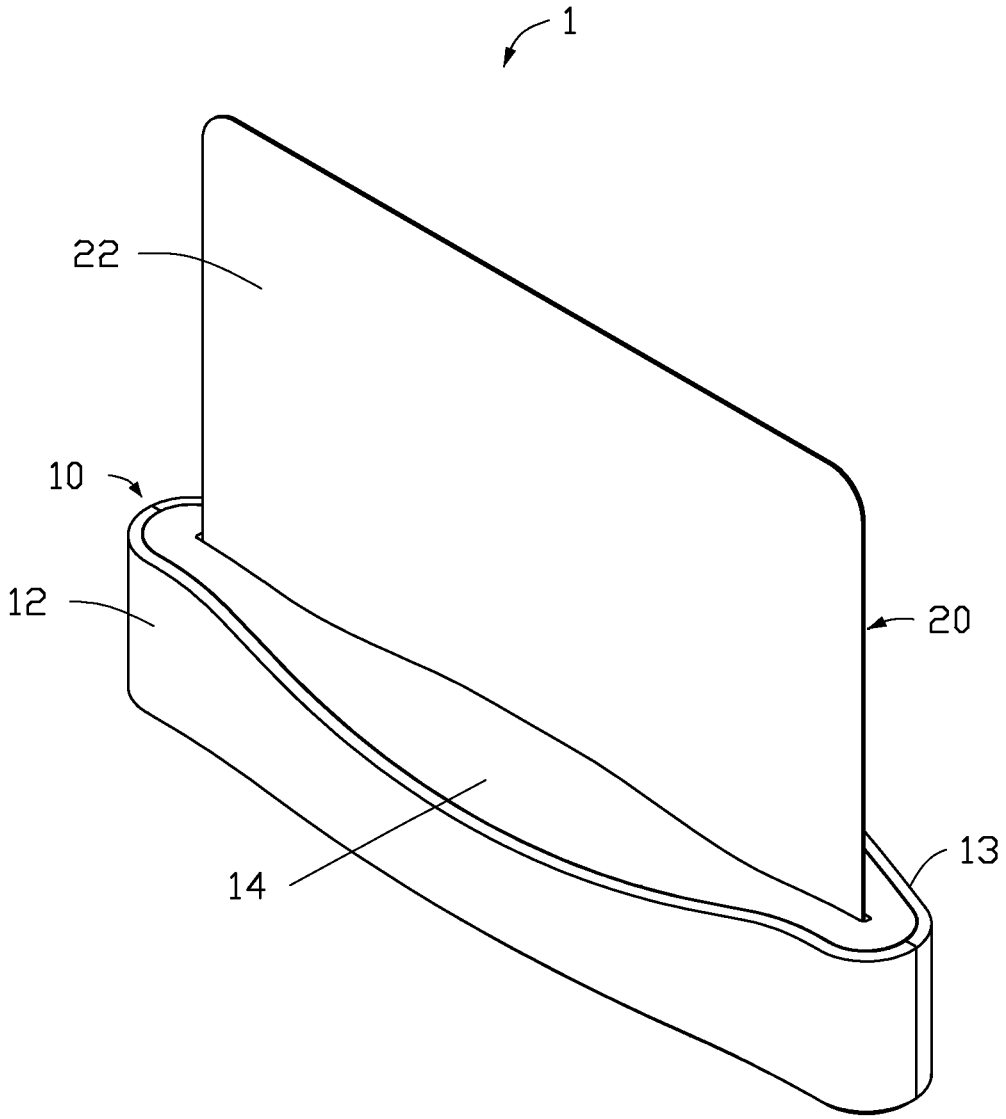
FIG. 1 is an isometric view of an embodiment of a speaker.

It will be appreciated that for simplicity and clarity of illustration, where appropriate, reference numerals have been repeated among the different figures to indicate corresponding or analogous elements. In addition, numerous specific details are set forth in order to provide a thorough understanding of the embodiments described herein. However, it will be understood by those of ordinary skill in the art that the embodiments described herein can be practiced without these specific details. In other instances, methods, procedures, and components have not been described in detail so as not to obscure the related relevant feature being described. Also, the description is not to be considered as limiting the scope of the embodiments described herein. The drawings are not necessarily to scale and the proportions of certain parts may be exaggerated to better illustrate details and features of the present disclosure.

Several definitions that apply throughout this disclosure will now be presented.

The term "coupled" is defined as connected, whether directly or indirectly through intervening components, and is not necessarily limited to physical connections. The connection can be such that the objects are permanently connected or releasably connected. The term "substantially" is defined to be essentially conforming to the particular dimension, shape, or other feature that the term modifies, such that the component need not be exact. For example, substantially cylindrical means that the object resembles a cylinder, but can have one or more deviations from a true cylinder. The term "comprising," when utilized, means "including, but not necessarily limited to"; it specifically indicates open-ended inclusion or membership in the so-described combination, group, series and the like.

Figure 2:
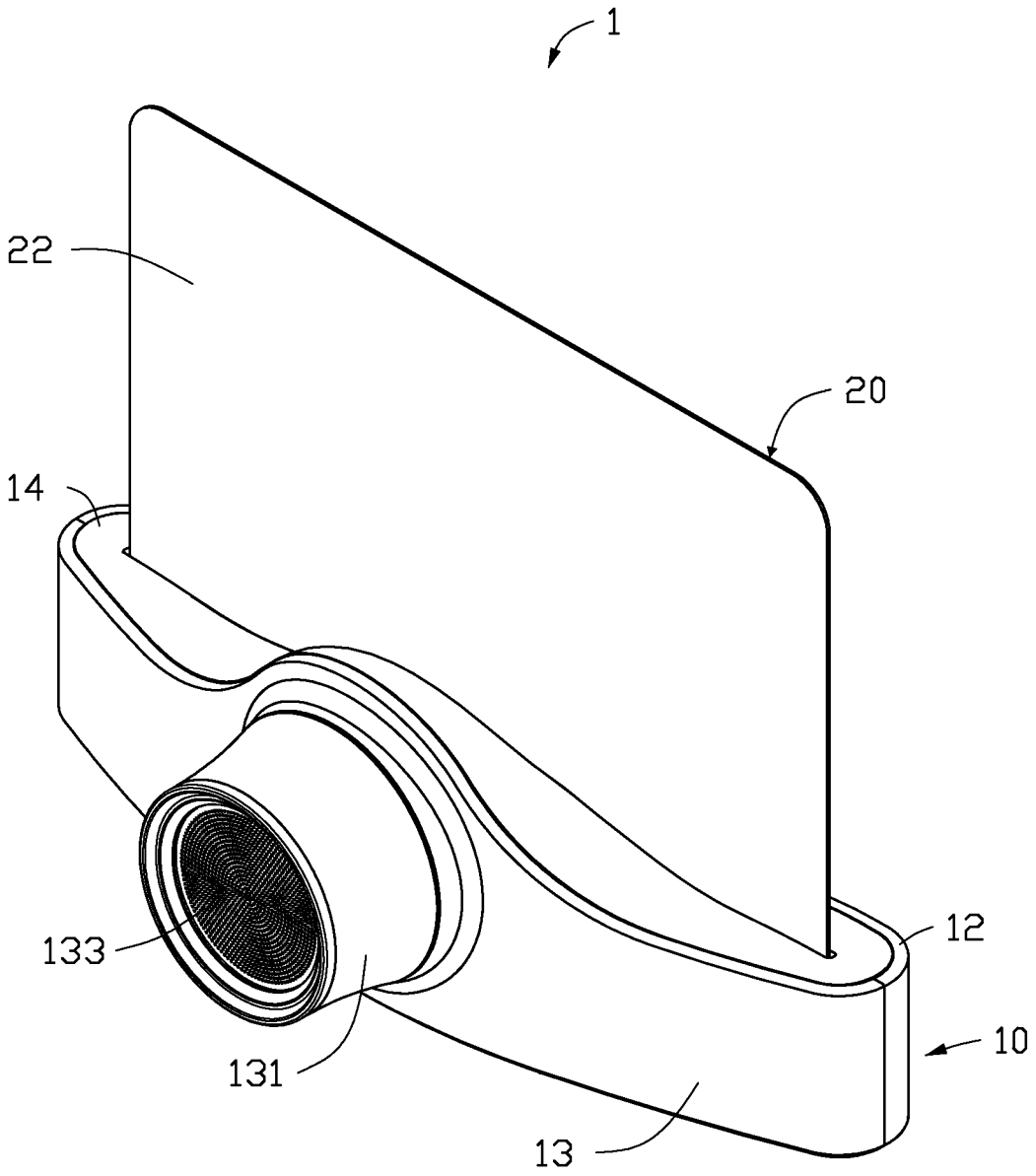
FIG. 2 is similar to FIG. 1, but showing the speaker from a different angle.
Figure 3:
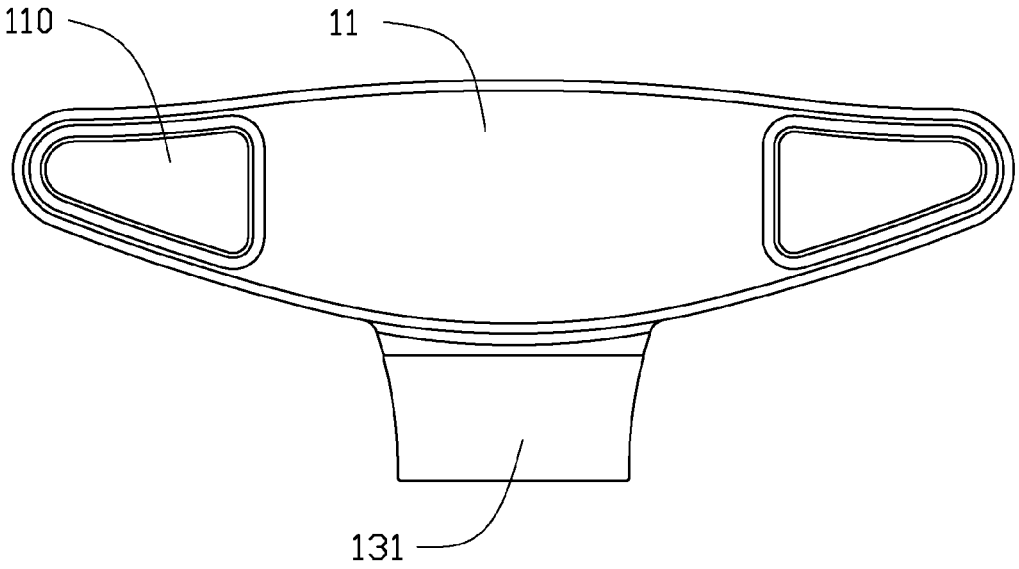
FIG. 3 is similar to FIG. 1, but showing the speaker from another different angle.

FIGS. 1-3 illustrate an embodiment of a speaker 1. The speaker 1 includes a hollow casing 10 and a vibration plate 20 secured to the casing 10. The vibrating plate 20 can be substantially rectangular, and can be made of metal or glass.

Figure 4:
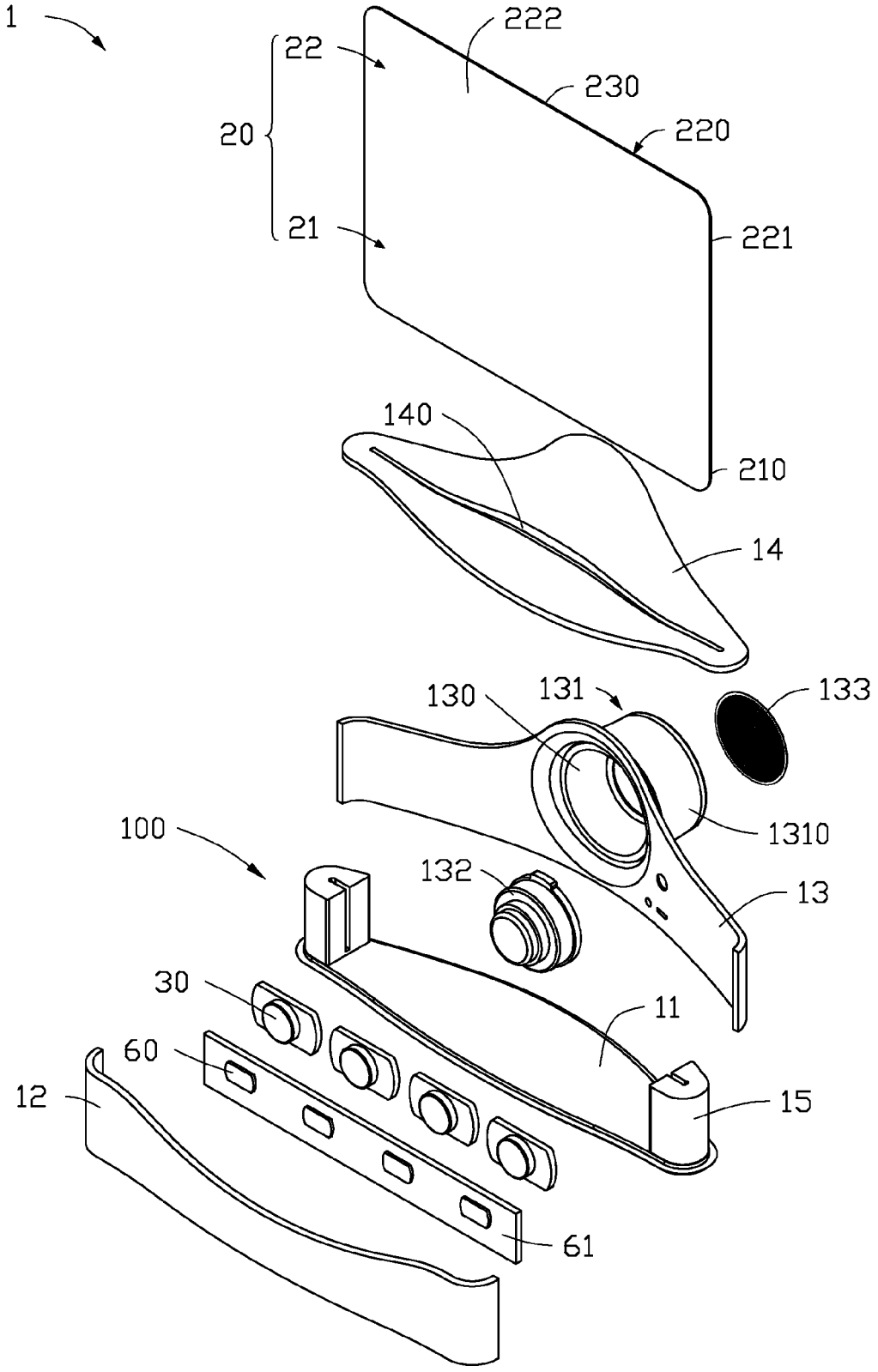
FIG. 4 is an exploded isometric view of the speaker of FIG. 1.

FIG. 4 illustrates that the casing 10 includes a base 11, a front cover 12, a back cover 13, and a top cover 14. The front cover 13 and the back cover 13 are connected to each other and are located between the base 11 and the top cover 14. The casing 10 includes a receiving space 100 cooperatively defined by the base 11, the front cover 12, the back cover 13, and the top cover 14. The base 11, the front cover 12, the back cover 13, and the top cover 14 can be integrally formed together. The top cover 14 defines a groove 140. The vibration plate 20 includes a first portion 21 received in the receiving space 100 and a second portion 22 protruding out of the casing 10 via the groove 140. In at least one embodiment, two clamping members 15 are received in the receiving space 100, and are respectively secured to portions of the base 11 adjacent to two junctions of the front cover 12 and the back cover 13. The clamping members 15 clamp two edges 210 of the first portion 21, thereby securing the vibration plate 20 in the receiving space 100.

Figure 5:
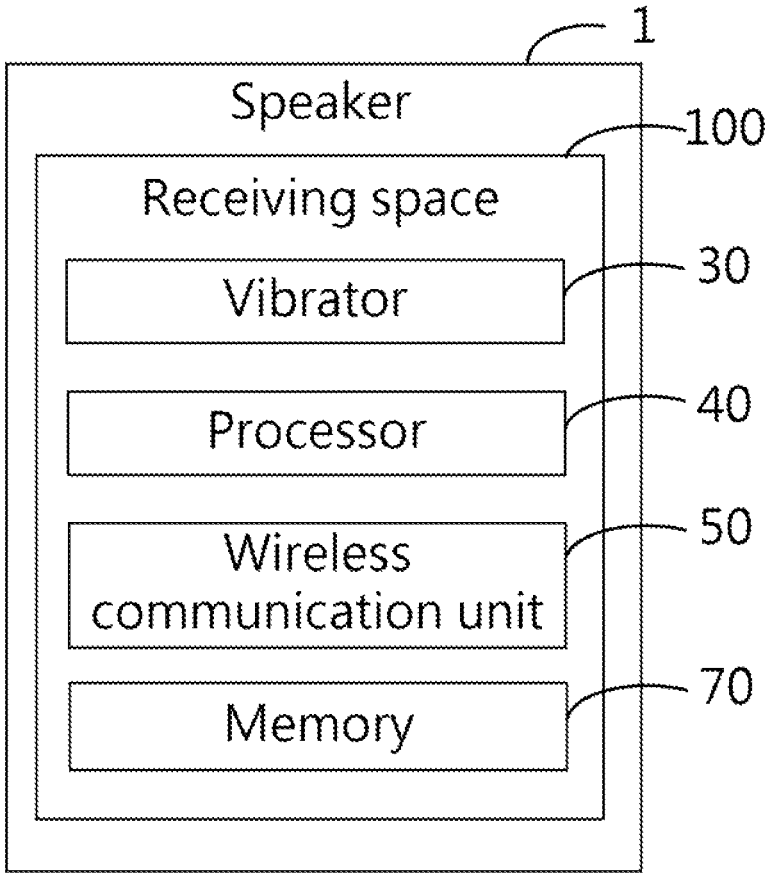
FIG. 5 is a block diagram of the speaker of FIG. 1.

FIG. 5 illustrates that the speaker 1 further includes at least one vibrator 30, a processor 40, and a wireless communication unit 50. Each vibrator 30 is received in the receiving space 100, and is attached to the first portion 21 of the vibration plate 20 (see FIG. 4). The processor 40 and the wireless communication unit 50 can also be received in the receiving space 100. The processor 40 is electrically coupled to each vibrator 30, and controls each vibrator 30 to vibrate when the speaker 1 receives a wireless signal via the wireless communication unit 50, thereby allowing the vibration plate 20 (see FIG. 4) to vibrate and output sound. The wireless communication unit 14 can be a BLUETOOTH communication unit or WiFi communication unit. In at least one embodiment, the speaker 1 further includes a memory 70 for storing an intensity threshold. The memory 70 can also be received in the receiving space 100. When the speaker 1 receives the wireless signal, the processor 40 further compares the intensity of the wireless signal with the intensity threshold, and determines whether the intensity of the wireless signal is greater than the intensity threshold. If so, the processor 40 controls each vibrator 30 to vibrate.

In at least one embodiment, at least one anti-vibration member 110 (shown in FIG. 3) is attached at a bottom of the base 11. The anti-vibration member 110 is able to absorb a major portion of the vibration from each vibrator 30, and prevent the speaker 1 from vibrating on a support surface (for example, a desktop). The anti-vibration member 110 can be made of flexible material such as rubber.

FIG. 4 further illustrates that in at least one embodiment, the back cover 13 defines a through hole 130. A hollow protrusion 131 extends from an interior surface of the through hole 130 away from the front cover 12. A mesh screen 133 is covered to an end of the protrusion 131 away from the front cover 12. A woofer 132 is fixedly received in the protrusion 131 and faces the mesh screen 133. The processor 40 is electrically coupled to the woofer 132, and controls the woofer 132 to generate sound of low frequency, thereby improving the sound output quality of the speaker 1.

In at least one embodiment, the protrusion 131 is a knob capable of being rotated relative to the back cover 13. Users can increase and decrease the volume of the sound output by the speaker 1 by rotating the protrusion 131 along a counterclockwise direction and a clockwise direction. In detail, the protrusion 131 is connected to a potentiometer (not shown). When the protrusion 131 is rotated relative to the back cover 13, the potentiometer rotates with the protrusion 131 to vary the resistance of the potentiometer. When the processor 40 controls each vibrator 30 to vibrate, the processor 40 further detects the resistance of the potentiometer, and varies the vibration data of the vibration from each vibrator 30 according to the detected resistance, thereby varying the volume of the sound output by the speaker 1. The vibration data of the vibration can be the amplitude or frequency of the vibration. In detail, the detected resistance of the potentiometer is increased or decreased when the protrusion 131 is rotated along the counterclockwise direction or the clockwise direction. Then, the vibration data of the vibration is controlled by the processor 40 to be increased or decreased. Thus, when protrusion 131 is rotated along the counterclockwise direction or the clockwise direction, the volume of the sound is increased or decreased. The subject matter herein is not limited to a potentiometer, and other methods of controlling sound based on interaction with knob 131 may also be used.

In one embodiment, the protrusion 131 may be fixedly connected to the back cover 13. The users can also increase or decrease the volume of the sound output by the speaker 1 by performing a first touch operation on the surface of the protrusion 131 along the counterclockwise direction or the clockwise direction. In detail, the protrusion 131 includes a first touch-sensitive panel 1310 on the surface. The first touch-sensitive panel 1310 includes sensing electrodes (not shown) capable of identifying the first touch operation on the protrusion 131. The sensing electrodes can be made of indium tin oxide (ITO). When the processor 40 controls each vibrator 30 to vibrate, the processor 40 further determines a direction of the first touch operation, and varies the vibration data of the vibration from each vibrator 30 according to the determined direction.

The users can also increase and decrease the volume of the sound output by the speaker 1 by performing a second touch operation on the top 220 of the second portion 22 along two different directions. In detail, the top 220 of the second portion 22 includes a second touch-sensitive panel 230. The second touch-sensitive panel 230 includes sensing electrodes (not shown) capable of identifying the second touch operation on the top 220. When the processor 40 controls each vibrator 30 to vibrate, the processor 40 further identifies the direction of the second touch operation on the top 220, and varies the vibration data of the vibration from each vibrator 30 according to the identified direction. It is notable that the second touch-sensitive 230 can also be arranged on each edge 221 of the second portion 22. That is, the users can also increase and decrease the volume of the sound output by the speaker 1 by performing the second touch operation on each edge 221 along a direction towards or away from the casing 10.

When the speaker 1 is outputting sound, the users can control the speaker 1 to stop outputting the sound by performing a third touch operation on at least one surface of the vibration plate 20. In detail, the second portion 22 of the vibration plate 20 further includes a third touch-sensitive panel 222 on at least one surface. The third touch-sensitive panel 222 includes sensing electrodes (not shown) capable of identifying the third touch operation on the second portion 22 in real-time. The memory 70 (see FIG. 5) of the speaker 1 stores a first preset trajectory and a second preset trajectory of the second touch operation. When the processor 40 controls each vibrator 30 to vibrate, the processor 40 further determines a trajectory of the identified third touch operation, and compares the identified trajectory with the first preset trajectory. If the identified trajectory is similar to the first preset trajectory, the processor 40 controls each vibrator 30 to stop vibrating, thereby controlling the speaker 1 to stop outputting the sound. After the processor 40 controls each vibrator 30 to stop vibrating, the processor 40 further compares the indentified trajectory of the third touch operation with the second preset trajectory. If the identified trajectory is similar to the second preset trajectory, the processor 40 controls each vibrator 30 to vibrate again, thereby controlling the speaker 1 to output the sound again.

In at least one embodiment, the vibration plate 20 is made of transparent material such as glass. At least one LED 60 is received in the receiving space 100, and is electrically coupled to the processor 40. The LED 60 is connected to a supporting bar 61, and the supporting bar 61 is adjacent to the vibration plate 20. When the processor 40 controls each vibrator 30 to vibrate, the processor 40 further controls each LED 60 to emit lights according to illumination data associated with the vibration data of the vibration. The lights can travel out of the casing 100 via the vibration plate 20. The illumination data of the lights can be the color or the intensity of the lights. In at least one embodiment, the illumination data of the lights is the intensity of the lights, and the vibration data of the vibration is the amplitude of the vibration. The intensity of the lights is proportional to the amplitude of the vibration. In this case, the greater the amplitude of the vibration from each vibrator 30 is, the stronger the intensity of the lights emitted by each LED 60 is.

In another embodiment, switches could be used to independently change the baseline light output.

It is to be understood, even though information and advantages of the present embodiments have been set forth in the foregoing description, together with details of the structures and functions of the present embodiments, the disclosure is illustrative only; changes may be made in detail, especially in matters of shape, size, and arrangement of parts within the principles of the present embodiments to the full extent indicated by the plain meaning of the terms in which the appended claims are expressed.

What is claimed is:

1. A speaker comprising:

a hollow casing defining a receiving space;

a vibration plate secured to the casing, the vibration plate having a first portion received in the receiving space and a second portion protruding out of the casing;

two clamping members fixedly received in the receiving space, each of the two clamping members clamping one edges of the first portion to secure the vibration plate in the receiving space;

at least one vibrator each received in the receiving space and attached to the first portion;

a wireless communication unit; and a processor electrically coupled to each vibrator, and configured to control each vibrator to vibrate when the speaker receives a wireless signal via the wireless communication unit, thereby allowing the vibration plate to vibrate and output sound.

2. The speaker of claim 1, wherein the processor is further configured to compare an intensity of the wireless signal with an intensity threshold when the speaker receives the wireless signal, determine whether the intensity of the wireless signal is greater than the intensity threshold, and control each vibrator to vibrate if the intensity of the wireless signal is greater than the intensity threshold.

3. The speaker of claim 1, wherein the casing comprises a base, a front cover, a back cover, and a top cover; the front cover and the back cover are connected to each other and are located between the base and the top cover; the receiving space are cooperatively defined by the base, the front cover, the back cover, and the top cover.

4. The speaker of claim 3, wherein the top cover defines a groove; the second portion protrudes out of the casing via the groove.

5. The speaker of claim 3, wherein the base, the front cover, the back cover, and the top cover are integrally formed together.

6. The speaker of claim 3, wherein at least one anti-vibration member is attached at a bottom of the base, and is able to absorb a major portion of the vibration from each vibrator.

7. The speaker of claim 3, wherein the back cover defines a through hole; a hollow protrusion extends from an interior surface of the through hole away from the front cover.

8. The speaker of claim 7, wherein a mesh screen is covered to an end of the protrusion away from the front cover; a woofer is fixedly received in the protrusion and faces the mesh screen; the processor is electrically coupled to the woofer, and is further configured to control the woofer to generate sound of low frequency.

9. The speaker of claim 7, wherein the protrusion is capable of being rotated relative to the back cover; a volume of the sound output by the speaker is capable of being controlled based on an interaction with the protrusion.

10. The speaker of claim 8, wherein the protrusion is connected to a potentiometer; the potentiometer rotates with the protrusion to vary a resistance thereof; the processor is further configured to detect the resistance of the potentiometer when the processor controls each vibrator to vibrate, and vary vibration data of the vibration from each vibrator according to the detected resistance, thereby varying the volume of the sound output by the speaker.

11. The speaker of claim 10, wherein the vibration data of the vibration is an amplitude or frequency of the vibration.

12. The speaker of claim 7, wherein the protrusion is fixedly connected to the back cover, and includes a first touch-sensitive panel on a surface thereof; the first touch-sensitive panel is capable of identifying a first touch operation on the protrusion; the processor is further configured to determine a direction of the first touch operation when the processor controls each vibrator to vibrate, and vary vibration data of the vibration from each vibrator according to the determined direction.

13. The speaker of claim 7, wherein a top of the second portion comprises a second touch-sensitive panel capable of identifying a second touch operation on the top; the processor is further configured to identify a direction of the second touch operation on the top when the processor controls each vibrator to vibrate, and vary vibration data of the vibration from each vibrator according to the identified direction.

14. The speaker of claim 7, wherein each edge of the second portion comprises a second touch-sensitive panel capable of identifying a second touch operation on the top; the processor is further configured to identify a direction of the second touch operation on the top when the processor controls each vibrator to vibrate, and vary vibration data of the vibration from each vibrator according to the identified direction.

15. The speaker of claim 1, wherein the second portion further comprises a third touch-sensitive panel on at least one surface thereof; the third touch-sensitive panel is capable of identifying a third touch operation on the second portion in real-time; the processor is further configured to determine a trajectory of the identified third touch operation when the processor controls each vibrator to vibrate, compare the identified trajectory with a first preset trajectory, and control each vibrator to stop vibrating if the identified trajectory is similar to the first preset trajectory.

16. The speaker of claim 15, wherein the processor is further configured to compare the indentified trajectory of the third touch operation with a second preset trajectory after the processor controls each vibrator to stop vibrating, and control each vibrator to vibrate again if the identified trajectory is similar to the second preset trajectory.

17. The speaker of claim 1, wherein the vibration plate is made of transparent material; at least one LED is received in the receiving space, and is electrically coupled to the processor; the processor is further configured to control each LED to emit lights according to illumination data associated with vibration data of the vibration.

18. The speaker of claim 17, wherein the illumination data of the lights is the intensity of the lights; the vibration data of the vibration is the amplitude of the vibration; the intensity of the lights is proportional to the amplitude of the vibration.

19. A speaker comprising:

a hollow casing comprising a base, a front cover, a back cover, and a top cover, the base, the front cover, the back cover, and the top cover cooperatively defining a receiving space;

a sound emitting vibration plate passing through the top cover of the casing, and having a first portion within the receiving space and a second portion protruding out of the top cover;

a communication unit configured to receive a speaker signal;

at least one vibrator within the receiving space and coupled to the first portion, the at least one vibrator being configured to vibrate in response to the speaker receiving the speaker signal via the communication unit;

wherein the second portion of the vibration plate is configured to vibrate and output sound in response to vibration of the at least one vibrator.

* * * * *